US009759403B2

(12) United States Patent
Ruhland et al.

(10) Patent No.: US 9,759,403 B2
(45) Date of Patent: Sep. 12, 2017

(54) RECESSED LIGHTING SYSTEM FOR DIRECT AND INDIRECT LIGHTING

(71) Applicant: GENERATION BRANDS LLC, Skokie, IL (US)

(72) Inventors: Chris Ruhland, Chicago, IL (US); Sean Lavin, Winnetka, IL (US)

(73) Assignee: GENERATION BRANDS LLC, Skokie, IL (US)

( * ) Notice: Subject to any disclaimer, the term of this patent is extended or adjusted under 35 U.S.C. 154(b) by 53 days.

(21) Appl. No.: 14/860,355

(22) Filed: Sep. 21, 2015

(65) Prior Publication Data

US 2017/0082266 A1 Mar. 23, 2017

(51) Int. Cl.

| | |
|---|---|
| ***F21S 8/02*** | (2006.01) |
| ***F21V 21/35*** | (2006.01) |
| ***F21V 7/00*** | (2006.01) |
| ***F21S 8/06*** | (2006.01) |
| *F21V 7/04* | (2006.01) |
| *F21V 21/30* | (2006.01) |
| *F21Y 113/00* | (2016.01) |
| *F21Y 103/10* | (2016.01) |
| *F21Y 115/10* | (2016.01) |
| *F21Y 113/20* | (2016.01) |

(52) U.S. Cl.

CPC ..... *F21V 7/0016* (2013.01); *F21S 8/02* (2013.01); *F21S 8/066* (2013.01); *F21V 21/35* (2013.01); *F21S 8/06* (2013.01); *F21V 7/005* (2013.01); *F21V 7/043* (2013.01); *F21V 21/30* (2013.01); *F21Y 2103/10* (2016.08); *F21Y 2113/00* (2013.01); *F21Y 2113/20* (2016.08); *F21Y 2115/10* (2016.08)

(58) Field of Classification Search

CPC ..... F21V 7/0016; F21V 7/005; F21V 7/0043; F21V 23/002; F21V 23/02; F21S 8/02; F21S 8/066

See application file for complete search history.

(56) References Cited

U.S. PATENT DOCUMENTS

| | | | | |
|---|---|---|---|---|
| 5,988,836 | A | 11/1999 | Swarens | |
| 7,455,535 | B2 | 11/2008 | Insalaco et al. | |
| 7,507,005 | B1 | 3/2009 | Mier-Langner | |
| 8,915,613 | B2 * | 12/2014 | Clark | F21S 2/005 362/249.01 |

(Continued)

*Primary Examiner* — Alan Cariaso
(74) *Attorney, Agent, or Firm* — Marshall, Gerstein & Borun LLP

(57) ABSTRACT

A recessed lighting system is disclosed that is capable of providing both direct and indirect lighting. The recessed lighting system may include first and second pluralities of light emitting diodes (LEDs) mounted on, respectively, first and second elongate track members. The first and second elongate track members may be spaced apart from each other by a distance, and a reflector may span at least a portion of that distance. The first and second pluralities of LEDs may be configured to emit light toward the reflector so that the reflector provides indirect lighting. A direct lighting fixture may be arranged between and slidably supported by the first and second elongate track members so that the direct lighting fixture is movable along the first and second elongate track members. Accordingly, the direct lighting fixture can be moved to a preferred position to spotlight an individual object or portion of the room.

20 Claims, 5 Drawing Sheets

(56) References Cited

U.S. PATENT DOCUMENTS

| | | | | |
|---|---|---|---|---|
| 9,228,735 | B2 * | 1/2016 | Liu | A47F 11/10 |
| 2016/0033098 | A1 * | 2/2016 | Bergman | H02G 3/20 362/418 |

* cited by examiner

RECESSED LIGHTING SYSTEM FOR DIRECT AND INDIRECT LIGHTING

FIELD OF DISCLOSURE

The present disclosure generally relates to lighting systems, and more particularly, lighting systems for recessed deployment in ceilings and other architectural structures.

BACKGROUND

Recessed lighting systems are commonly used indoors to provide the effect of light shining through a hole in a ceiling or wall. Recessed lighting systems generally include a light fixture installed in a ceiling or wall recess. Depending on the desired illumination scheme, the light fixture is typically configured to provide either direct lighting or indirect lighting.

Direct lighting involves casting light primarily in one direction to illuminate an individual object (e.g., a painting, a table, a kitchen counter, etc.) or limited portion of a room, or even for general illumination purposes. A can light is one example of a recessed lighting system incorporating a direct lighting light fixture. Direct lighting tends to create glare and shadows and therefore is typically not used for illuminating a large area or an entire room.

Indirect lighting, on the other hand, provides more diffuse lighting and is suitable for illuminating large areas. Indirect lighting involves bouncing light off a reflective surface, thereby redirecting and/or scattering the light to various portions of a room. While indirect lighting reduces glare and provides generally uniform luminance levels, it can be uneconomical since at least some of the light is absorbed by the reflective surface. Moreover, because of its diffuse nature, indirect lighting is generally not suitable for spotlighting an individual object.

Various applications can benefit from including both direct and indirect lighting. For example, it can be useful to illuminate a kitchen surface where food is typically prepared, such as a kitchen counter, more brightly than other areas of the kitchen. Direct lighting can be used to spotlight the food preparation area(s), whereas indirect lighting can be used to illuminate the remainder of the kitchen. In the past, such an illumination scheme required the installation of separate direct and indirect lighting fixtures. This tends to be labor-intensive and require the formation of at least two recesses in an existing architectural structure to receive the distinct indirect and direct lighting fixtures.

The present disclosure sets forth various recessed lighting systems embodying advantageous alternatives to existing recessed lighting systems and that may address one or more of the challenges or needs mentioned above.

SUMMARY

One aspect of the present disclosure provides a recessed lighting system including first and second elongate track members arranged alongside each other, first and second electric conductors, a reflector, a direct lighting fixture, and first and second pluralities of light emitting diodes (LEDs) mounted, respectively, on the first and second elongate track members. The first elongate track member may include a first recess extending longitudinally for a length of the first elongate track member, and the second elongate track member may include a second recess extending longitudinally for a length of the second elongate track member. The first electric conductor may be disposed in the first recess and extend longitudinally for the length of the first elongate track member. The second electric conductor may be disposed in the second recess and extend longitudinally for the length of the second elongate track member. The first and second elongate track members may be spaced apart from each other by a distance, and the reflector may span at least a portion of that distance. The first and second pluralities of LEDs may be configured to emit light toward the reflector so that the reflector redirects the light to provide indirect lighting. The direct lighting fixture may be arranged between and slidably supported by the first and second elongate track members so that the direct lighting fixture is movable along the first and second elongate track members.

Another aspect of the present disclosure provides a light emitting track assembly for use in a recessed lighting system. The light emitting track assembly may include first and second elongate track members arranged alongside each other, a reflector, and a first plurality of LEDs. The first elongate track member may include a first recess extending longitudinally for a length of the first elongate track member. A first electric conductor may be disposed in the first recess and extend longitudinally for the length of the first elongate track member. The first and second elongate track members may be spaced apart from each other by a distance, and the reflector may span at least a portion of that distance. The first plurality of LEDs may be mounted on the first elongate track member and configured to emit light toward the reflector so that the reflector redirects the light to provide indirect lighting.

Yet another aspect of the present disclosure provides a recessed lighting system including a means for generating indirect lighting and a means for generating direct lighting. The means for generating indirect lighting may include at least one plurality of LEDs arranged parallel to a longitudinal axis of the recessed lighting system. The means for generating direct lighting may be suspended from the means for generating indirect lighting and movable in a direction parallel to the longitudinal axis of the recessed lighting system.

DETAILED DESCRIPTION

The present disclosure generally concerns recessed lighting systems and a light emitting track member for use in recessed lighting systems. The recessed lighting systems disclosed herein can be implemented in various applications requiring or benefiting from direct and/or indirect lighting. In general, the recessed lighting systems generate indirect lighting by including one or more elongate track members on which are mounted one or more rows of light emitting diodes (LEDs). The LEDs emit light rays towards a curved reflector, which in turn may scatter and/or redirect the light rays to various portions of a room. To provide direct lighting, the recessed lighting systems may include one or more direct lighting fixtures suspended from the one or more elongate track members. The one or more direct lighting fixtures may be slidably supported by the one or more elongate track members so that they can be moved to spotlight various objects or portions of a room. The combination of indirect and direct lighting provides users with greater flexibility in choosing a room's illumination scheme, and allows users to illuminate individual objects or portions of a room more brightly than others. Additionally, since the indirect and direct lighting fixtures are incorporated in a single assembly, their installation may be less burdensome than conventional indirect and direct light fixtures, which typically must be installed in separate ceiling or wall recesses. Another benefit of the presently disclosed recessed lighting system is that it may incorporate one or more decorative lips which makes it appear that the recessed lighting system is integrally formed with a ceiling or other architectural structure.

Each of the foregoing components and advantages of the recessed lighting system will be now be described in more detail with reference to the accompanying figures.

Figure 1:
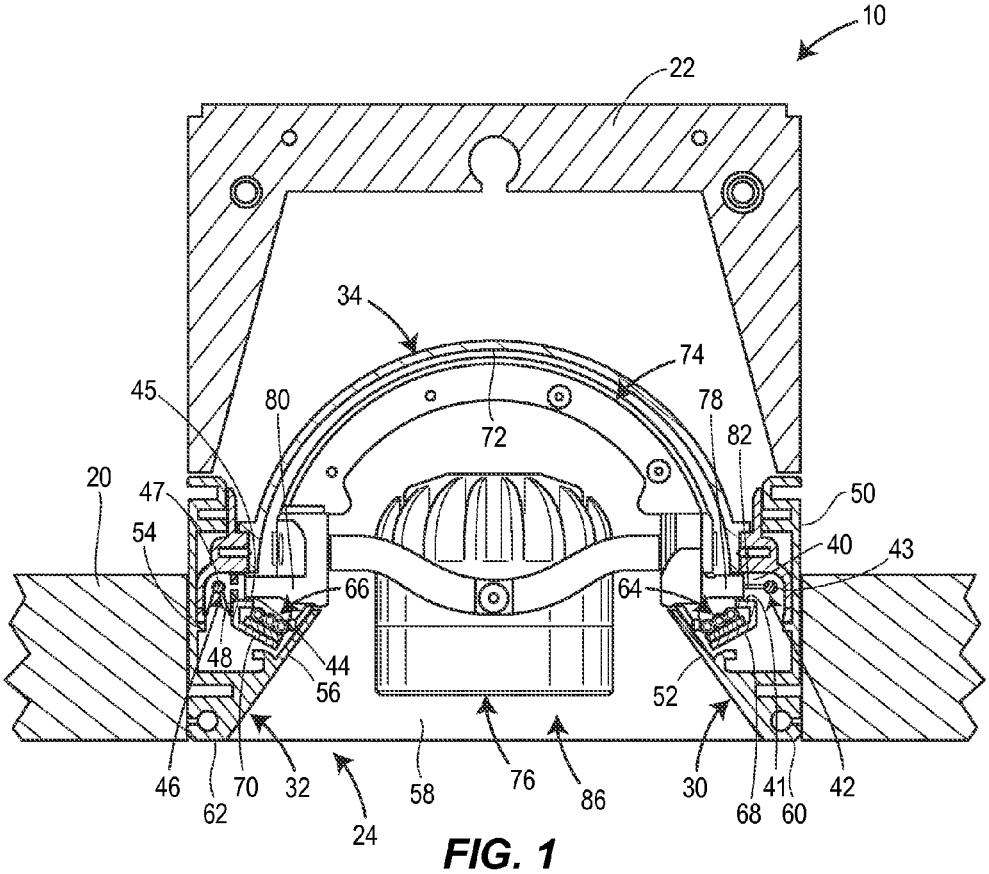
FIG. 1 is a cross-sectional view of a recessed lighting system constructed in accordance with principles of the present disclosure.

FIG. 1 depicts a cross-sectional view of a recessed lighting system 10 constructed in accordance with principles of the present disclosure and installed in a ceiling 20. As described below in more detail, the recess lighting system 10 may be deployed in other architectural structures, including, for example, a vertical wall or even a floor. The recessed lighting system 10 may include a housing 22 inserted into a recess in the ceiling 20. The housing 22 may contain a light emitting track assembly 24 and a direct lighting fixture 26. The housing 22 may be anchored to the ceiling 20 and the light emitting track assembly 24 may be removably attached to an inner surface of the housing 22. The housing 22 may be constructed of a fireproof material such as metal to contain and prevent the spread of an inadvertent electrical fire caused by the light emitting track assembly 24 and/or the direct lighting fixture 26. The housing 22 may have an elongate, three-dimensional shape such as a rectangular box. Additionally, the housing may have an open end for the insertion of the light emitting track assembly 24 and the direct lighting fixture 26.

The light emitting track assembly 22 may be constructed from a first elongate track member 30, a second elongate track member 32, and a reflector 34. The first and second elongate track members 30 and 32 may be arranged on opposite sides of the housing 22 and, as illustrated in the perspective view of FIG. 6, extend parallel to and alongside a longitudinal axis A of the recessed lighting system 10. The reflector 34 may also extend parallel to and alongside the longitudinal axis A. While the longitudinal axis A illustrated in FIG. 6 follows a linear path, in other embodiments it may follow a curved path, or form an angle of 90 degrees if, for example, the recessed lighting system 10 is arranged at the corner between a ceiling and a vertical wall.

The first and second elongate track members 30 and 32 are spaced apart by a distance and the reflector 34 spans a portion or the entirety of that distance. In at least one embodiment, the reflector 34 connects the first elongate track member 30 directly to the second elongate track member 32.

The first elongate track member 30 includes a first recess 40 extending longitudinally and continuously for a length of the first elongate track member 30. The first recess 40 may be an opening formed in an inwardly facing surface of the first elongate track member 30 or a groove formed in an inwardly facing surface of the first elongate track member 30. A first upwardly facing sliding surface 41 may define a portion of the first recess 40 and slidably engage a first protrusion 78 of the direct lighting fixture 26.

A first electric conductor 42 may be disposed in the first recess 40 and may be supplied with electricity from an external power source. The first electric conductor 42 may extend along a portion, or the entire, length of the first recess 40. Arranging the first electric conductor 42 inside the first recess 40 makes it less likely that a user will touch the first electric conductor 42 with his or her fingers. In some embodiments, the first electric conductor 42 may consist solely of a cylindrical bus bar 43, as shown in FIG. 1. In other embodiments, the first electric conductor 42 may include a cylindrical bus bar and an electrically conductive clip fit over the cylindrical bus bar 43. The electrically conductive clip (not illustrated) may have a planar surface to facilitate sliding contact with an electric contact of the direct lighting fixture 26. In some embodiments the bus bar 43 may have rectangular cross section, or any other suitable cross section.

The second elongate track member 32 may be constructed in a similar manner as the first elongate track member 30. A second recess 44 may be formed in the second elongate track member 32 and extend longitudinally and continuously for a length of the second elongate track member 32. The second recess 44 may be an opening formed in an inwardly facing surface of the second elongate track member 32 or a groove formed in an inwardly facing surface of the second elongate track member 32. A second upwardly facing sliding surface 45 may define a portion of the first recess 44 and slidably engage a second protrusion 80 of the direct lighting fixture 26.

A second electric conductor 46 may disposed in the second recess 44 and may be supplied with electricity from the external power source. The second electric conductor 46 may extend along a portion, or the entire, length of the second recess 44. In some embodiments, the second electric conductor 46 may consist solely of a cylindrical bus bar. In other embodiments, such as the one illustrated in FIG. 1, the second electric conductor 46 may include a cylindrical bus bar 47 and an electrically conductive clip 48 fit over the cylindrical bus bar 47. The electrically conductive clip 48 may possess a planar surface 49 to facilitate sliding contact with an electric contact of the direct lighting fixture 26.

In some embodiments, the first and second electric conductors 42 and 46 may be electrically coupled to a low-voltage transformer, which decreases the voltage of the electricity supplied by the external power source. The low-voltage transformer may output a voltage to the first and second electric conductors 42 and 46 in a range of approximately (e.g., ±10%) 60V or less. In some embodiments, the voltage outputted by the low-voltage transformer may be equal to approximately (e.g., ±10%) 6V, or 7V, or 12V, or 14V, or 24V, or 48V, or 60V.

Still referring to FIG. 1, the first elongate track member 30 may include an outer wall 50 fixed to the housing 22, and an inner wall 52 inclined relative to the outer wall 50. Similarly, the second elongate track member 32 may include an outer wall 54 fixed to the housing 22, and an inner wall 56 inclined relative to the outer wall 54. The inner walls 52 and 56 may be planar, as shown in FIG. 1, or curved, or any combination of curved and planar surfaces. The inner walls 52 and 56 may define an opening 58 of the recessed lighting system 10 that gradually increases in width from the interior of the recessed lighting system 10 to an exterior of the recessed lighting system 10.

The inner wall 52 may extend from a downwardly facing end surface 60 of the first elongate track member 30, and the inner wall 56 may extend from a downwardly facing end surface 62 of the second elongate track member 32. When the recessed lighting system 10 is installed in a ceiling or wall recess, the downwardly facing end surfaces 60 and 62 may be flush with the surface of the ceiling or wall, as depicted in FIG. 1. Therefore, a seamless transition may exist between the surface of the ceiling or wall and the inner wall 52 on one side of the recessed lighting system 10 and the inner wall 56 on the other side of the recessed lighting system 10. This seamless transition may give the appearance that the first and second track members 30 and 32 are integrally formed with the ceiling or wall, which is ascetically pleasing to some consumers. The inner walls 52 and 56 may be covered by paint and/or drywall material to further the illusion that the first and second track members 30 and 32 are integrally formed with the ceiling or wall. Accordingly, the inner walls 52 and 26 may serve as decorative lips, in addition to their other structural and operational functions.

Still referring to FIG. 1, mounted on the first and second elongate track members 30 and 32 are, respectively, first and second pluralities of LEDs 64 and 66. The first plurality of LEDs 64 may include one or more rows of LEDs extending parallel to the longitudinal axis A of the recessed lighting system 10. The first plurality of LEDs 64 may be mounted on a longitudinal flange 68 of the first elongate track member 30 located between the outer wall 50 and the inner wall 52. Accordingly, the first plurality of LEDs 64 may be hidden from view by the inner wall 52 when the recessed lighting system 10 is installed in a ceiling or wall. Furthermore, the longitudinal flange 68 may be angled relative to a horizontal direction so that each of the first plurality of LEDs 64 emits light in an upward direction at an angle relative to a vertical direction.

The second plurality of LEDs 66 may include one or more rows of LEDs extending parallel to the longitudinal axis A of the recessed lighting system 10. The second plurality of LEDs 66 may be mounted on a longitudinal flange 70 of the second elongate track member 32 located between the outer wall 54 and the inner wall 56. Accordingly, the second plurality of LEDs 66 may be hidden from view by the inner wall 56 when the recessed lighting system 10 is installed in a ceiling or wall. Furthermore, the longitudinal flange 70 may be angled relative to the horizontal direction so that each of the second plurality of LEDs 66 emits light in an upward direction at an angle relative to the vertical direction.

In alternative embodiments, other types of light sources may be mounted on the first and second elongate track members 30 and 32 in addition to, or as a substitute for, the first and second pluralities of LEDs 64 and 66. These light sources include, but are not limited to, incandescent, fluorescent, halogen, and/or high-intensity discharge light bulbs.

During operation, the first and second pluralities of LEDs 64 and 66 may emit light toward the reflector 34. The reflector 34 may include a reflective surface 72 that redirects the light out through the opening 58 and into the room. Accordingly, the reflector 34 functions to provide indirect lighting. In some embodiments, the reflective surface 72 may be textured so that it scatters the light during reflection, thereby providing more diffuse indirect light. Additionally, or alternatively, the reflective surface 72 may be painted a desired color and/or etched with a pattern such that the reflective surface 72 is aesthetically pleasing.

Figure 2:
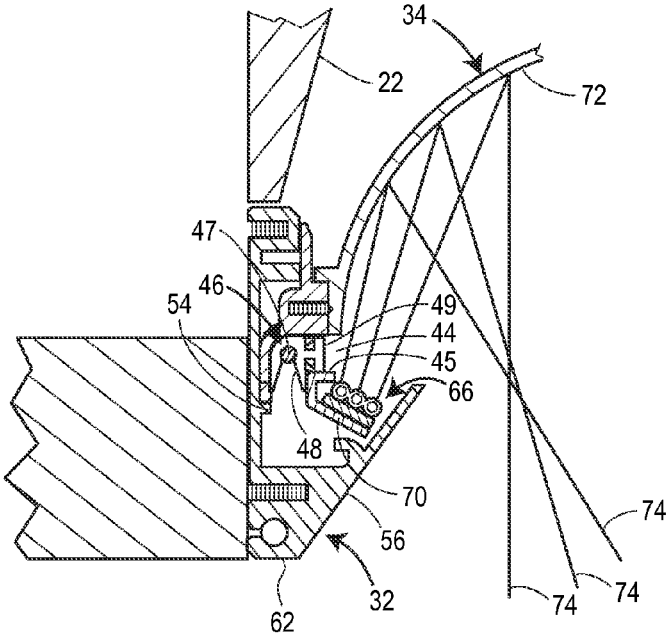
FIG. 2 is an enlarged, cross-sectional view of a portion of the recessed lighting system of FIG. 1 taken along a plane that does not intersect the direct lighting fixture.

Referring to FIG. 2, the reflective surface 72 may be curved so that the reflected light rays 74 are distributed over a substantial portion of the room. In some embodiments, the reflective surface 72 may be semi-cylindrical and extend longitudinally for a length of the reflector 34. Other curvatures for the reflective surface 72 are possible, including a parabolic and/or hyperbolic curvatures. In still further embodiments, the reflective surface 72 may be planar and horizontal, triangular, or any other suitable polygonal shape.

Figure 3:
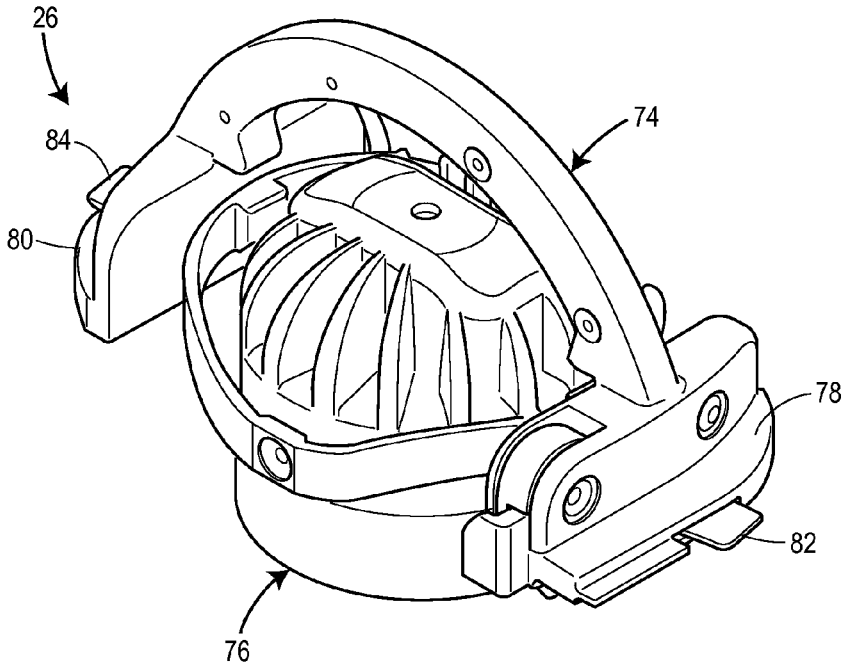
FIG. 3 is a perspective view of the direct lighting fixture used in the recessed lighting system of FIG. 1.

Referring to FIGS. 1 and 3, the direct lighting fixture 26 may include a mounting structure 74 and a light source housing 76. The light source housing 76 may be rotatably attached to the mounting structure 74 such that the light source housing 76 is rotatable about an axis orthogonal to the longitudinal axis A. In other embodiments, the rotational axis of the light source housing 76 may be parallel to the longitudinal axis A. The light source housing 76 may contain a third plurality of LEDs, or alternatively, any one of an incandescent, fluorescent, halogen, high-intensity discharge light bulb, or any combination thereof.

First and second support tabs 78 and 80 may protrude from opposite ends of the mounting structure 74. To connect the mounting structure 74 to the first and second elongate track members 30 and 32, the first support tab 78 may be inserted into the first recess 40, and the second support tab 80 may be inserted into the second recess 44. While the first and second recesses 40 and 44 may restrain movement of the first and second support tabs 78 and 80 in a direction orthogonal to the longitudinal axis A, the first and second recesses 40 and 44 may permit back-and-forth movement of the first and second support tabs 78 and 80 in a direction parallel to the longitudinal axis A. The direct lighting fixture 26 may be moved manually by a user, or automatically be electric motors (not illustrated), along the first and second elongate track members 30 and 32. During movement of the direct lighting fixture 26, the first support tab 78 may slidingly engage the sliding surface 41, and the second support tab 80 may slidingly engage the sliding surface 45.

A first spring-biased electric contact 82 may protrude from the terminal end of the first support tab 78, and a second spring-biased electric contact 84 may protrude from the terminal end of the second support tab 80. The first spring-biased electric contact 82 may retract inside the first support tab 78 upon the application of a compressive force. Similarly, the second spring-biased electric contact 84 may retract inside the second support tab 80 upon the application of a compressive force. As illustrated in FIG. 1, when the first support tab 78 is inserted into the first recess 40, the first spring-biased electric contact 82 engages (e.g., directly contacts) the first electric conductor 42 and the second spring-biased electric contact 84 engages (e.g., directly contacts) the second electric conductor 46. In the embodiment illustrated in FIG. 1, the second spring-biased electric contact 84 is pressed entirely within the second support tab 80 by the planar surface 49 of the electrically conductive clip 48 forming the second electric conductor 46. During movement of the direct lighting fixture 26, the first spring-biased electric contact 82 may slidingly engage the first electric conductor 42, and the second spring-based electric contact 84 may slidingly engage the second electric conductor 46. When the first spring-biased electric contact 82 engages the first electric conductor 42 and the second spring-biased electric contact 84 engages the second electrical conductor 46, a closed circuit may be formed that supplies the light source of the direct lighting fixture 26 with electricity.

The ability of the direct lighting fixture 26 to move along the first and second elongate track members 30 and 32 allows a user to adjust the position of the direct lighting fixture 26 to cast light on target object (e.g., a painting, a table, a kitchen counter, etc.) or limited portion of a room. Additionally, the ability to rotate the light source housing 76 relative to the mounting structure 74 provides the user with even more flexibility in choosing which objects to spotlight with the direct lighting fixture 26.

In some embodiments, the direct lighting fixture 26 and the first and second plurality of LEDs 64 and 66 may be operated simultaneously, so that the object which is illuminated by the direct lighting fixture 26 also receives indirect light from the first and second plurality of LEDs 64 and 66. In some embodiments, the direct lighting fixture 26 and the first and second plurality of LEDs 64 and 66 may be independently controllable, so that the target object can be provided with only direct light, or only indirect light.

While the present embodiment of the recessed lighting system 10 utilizes a single direct lighting fixture, other embodiments may arrange two, three, four, or more direct lighting fixtures along the length of the recessed lighting system 10. Also, the recessed lighting system 10 may incorporate different types of direct lighting fixtures than the one illustrated in FIG. 3.

Figure 4:
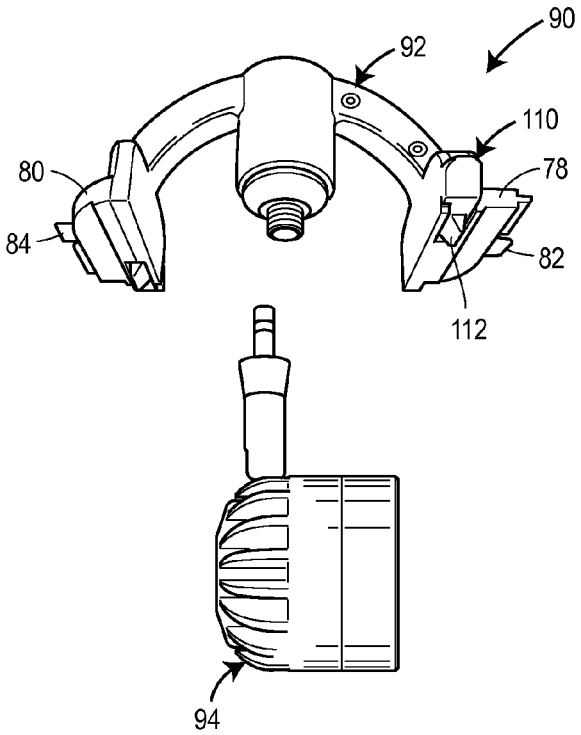
FIG. 4 is an exploded assembly view of another embodiment of a direct lighting fixture which can be used in the recessed lighting system of FIG. 1.
Figure 6:
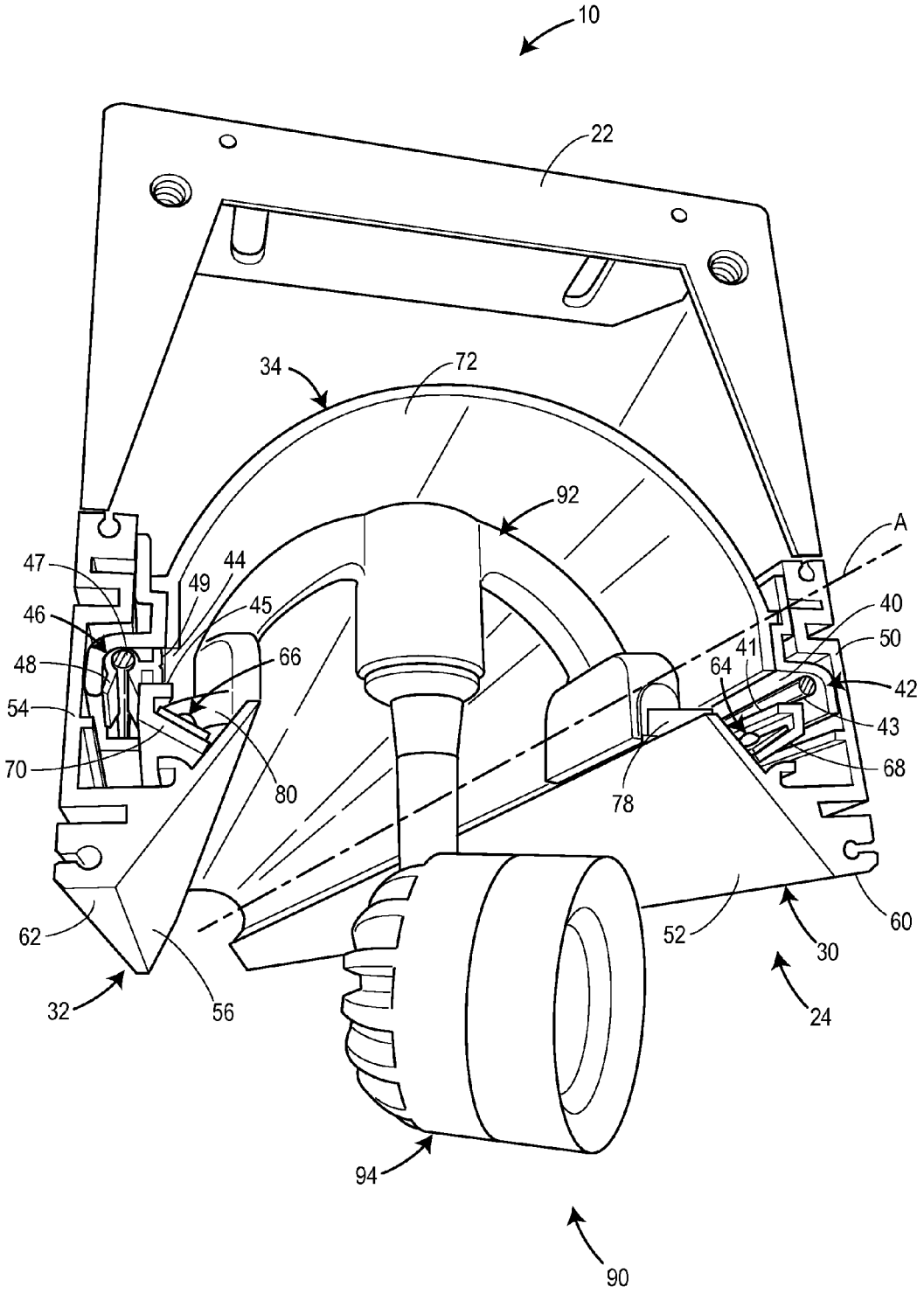
FIG. 6 is a perspective view of the recessed lighting system of FIG. 1, incorporating the direct lighting fixture of FIG. 4.

FIG. 4 illustrates another embodiment of a direct lighting fixture 90 including a mounting structure 92 and a light source housing 94 rotatably attached to the mounting structure 92. The light source housing 94 may be rotatable about an axis that is orthogonal to the longitudinal axis A and parallel to the vertical direction when the direct lighting fixture 90 is installed in a ceiling recess. As seen in FIG. 6, the mounting structure 92 may be slidably supported by the first and second elongate track members 30 and 32 in a similar manner as the mounting structure 74. Furthermore, the light source housing 94 threadably engages the mounting structure 92 so that the light source housing 94 can be replaced and/or removed from the mounting structure 92 for maintenance with relative ease.

Figure 5:
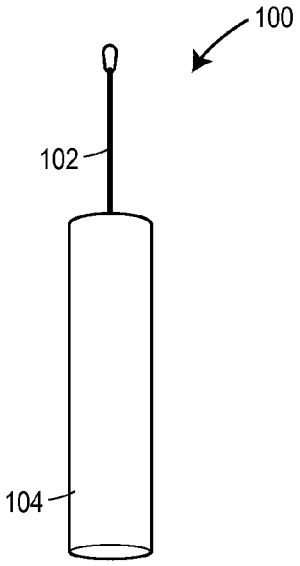
FIG. 5 is a perspective view of yet another embodiment of a direct lighting fixture which can be used in the recessed lighting system of FIG. 1.

FIG. 5 depicts another embodiment of a direct lighting fixture 100 having a pendant-like appearance. The direct lighting fixture 100 includes a flexible cable 102 (e.g., a cord, chain, rope, etc.) that connects a light source housing 104 to a mounting structure (not shown). The mounting structure may be identical to the mounting structure 92 illustrated in FIG. 4.

Figure 7:
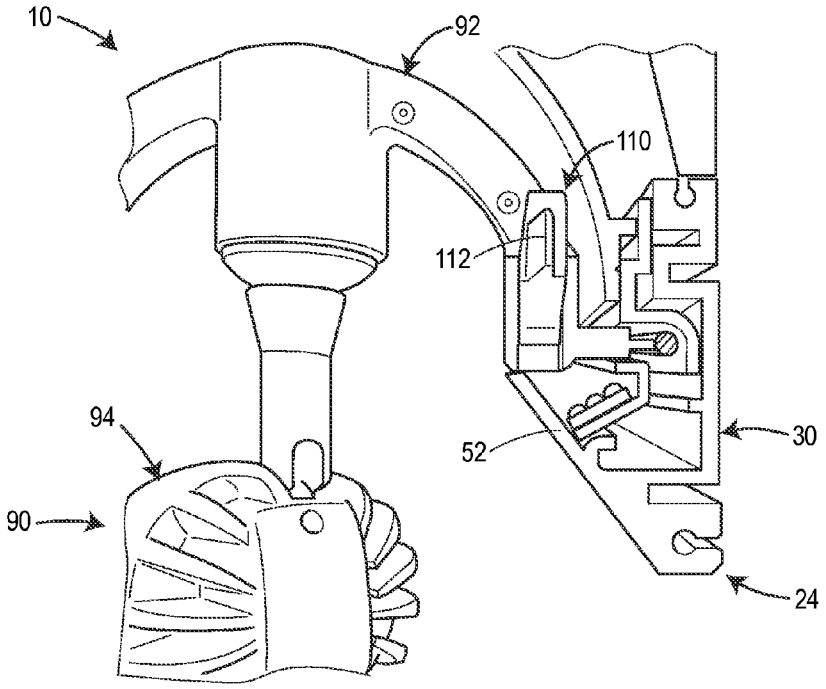
FIG. 7 is a perspective view of the recessed lighting system of FIG. 6 with a locking member arranged in an unlocked position.
Figure 8:
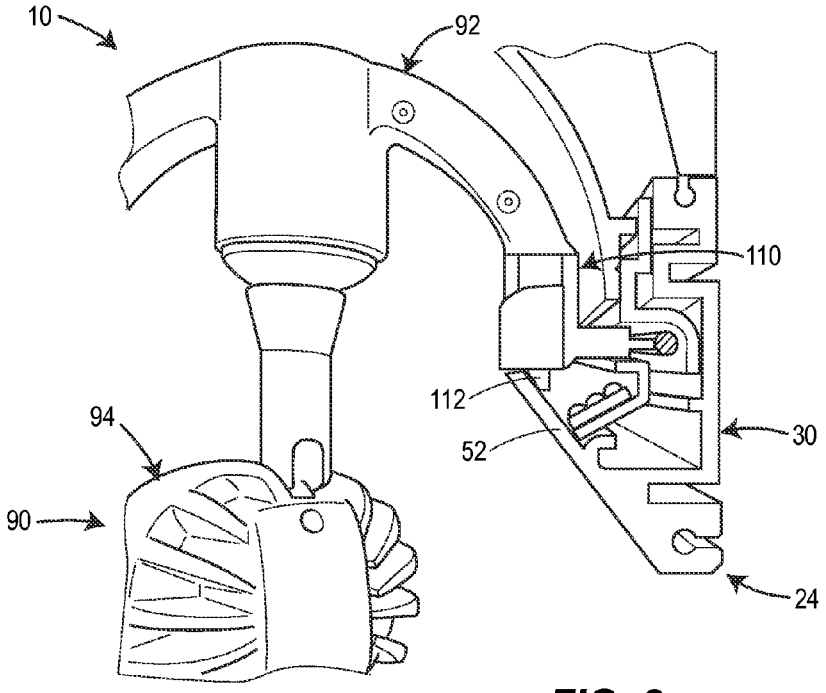
FIG. 8 is a perspective view of the recessed lighting system of FIG. 6 with the locking member arranged in a locked position.

In some embodiments, the direct lighting fixture may include one or more locking members configured to prevent movement of the direct lighting fixture relative to the first and second elongate track members when engaged and allow movement of the direct lighting fixture relative to the first and second elongate track members when disengaged. FIGS. 7 and 8 illustrate a locking member 110 rotatably attached to the mounting structure 92 of the direct lighting fixture 90. In FIG. 7, the locking member 110 is rotated counterclockwise to a unlock position where its stop 112 does not frictionally engage the inner wall 52 of the first elongate track member 30. Accordingly, the direct lighting fixture 90 is allowed to move relative to the first elongate track member 30. In FIG. 8, the locking member 110 is rotated clockwise to a lock position where the stop 112 frictionally engages the inner wall 52 of the first elongate track member 30. As a result, the direct lighting fixture 90 is prevented from moving relative to the first elongate track member 30. In some embodiments, the direct lighting fixture may include a second locking member configured in the same manner as the locking member 110, except that it selectively engages the inner wall 56 of the second elongate track member 32.

Figure 9:
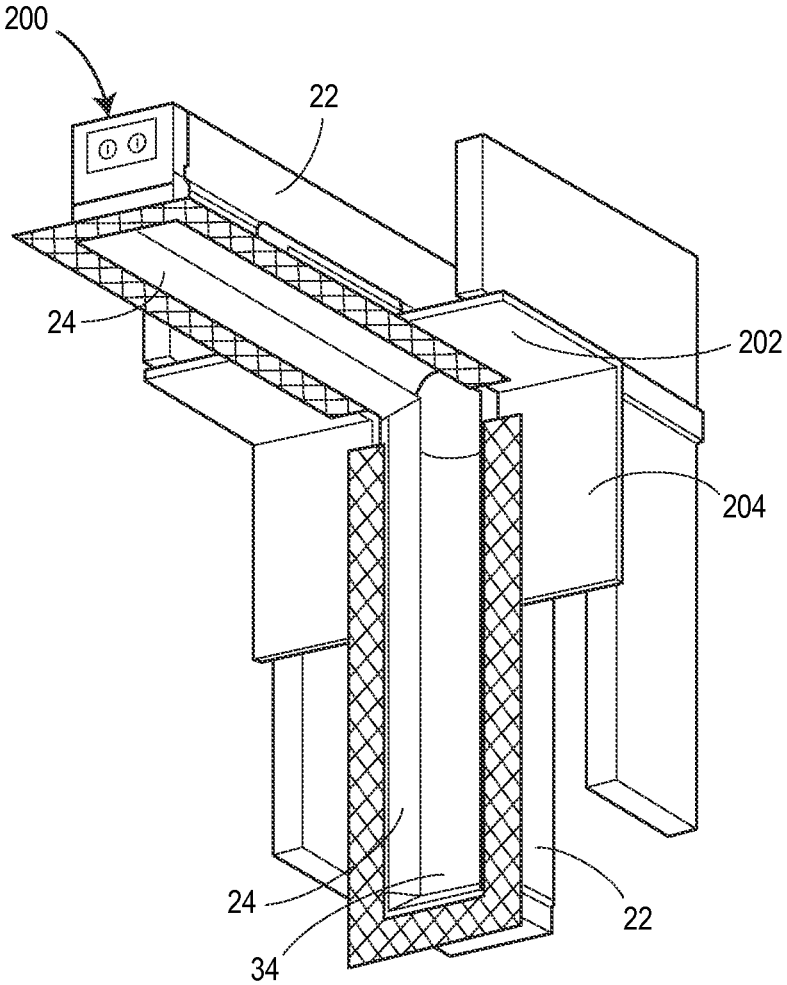
FIG. 9 is a perspective view of another embodiment of a recessed lighting system installed at the transition between a ceiling and a vertical wall.

While the foregoing embodiments of the recessed lighting system are configured for installation in a generally planar surface such as a ceiling or a wall, other embodiments of the recessed lighting system may be configured for installation in non-planar surfaces. FIG. 9 illustrates a recessed lighting system 200 configured to span the transition (i.e., corner) between a ceiling 202 and a vertical wall 204. The recessed lighting system 200 may include the same components as the recessed lighting system 10, except that the middle of the recessing lighting system 200 includes a 90 degree turn. For the sake of clarity, a direct lighting fixture has been omitted from FIG. 9. In alternative embodiments, the recessed lighting system 200 may be installed at the transition (i.e., corner) between two vertical walls.

From the foregoing, it can be seen that the present disclosure advantageously provides recessed lighting systems, and light emitting track members for use in recessed lighting systems, which provide both indirect and direct lighting. Incorporating both an indirect lighting fixture and a direct lighting fixture into a single assembly eliminates the need to create separate ceiling or wall recesses to accommodate the indirect and direct lighting fixtures. Moreover, the recessed lighting systems of the present disclosure advantageously allow the position of a direct lighting fixture to be adjusted, thereby providing a user with greater flexibility in choosing an illumination scheme. Furthermore, the recessed lighting system of the present disclosure can be provided with one or more decorative lips which makes it appear as if the recessed lighting system is integrally formed with the ceiling or wall.

While the invention has been described in connection with various embodiments, it will be understood that the invention is capable of further modifications. This application is intended to cover any variations, uses or adaptations of the invention following, in general, the principles of the invention, and including such departures from the present disclosure as, within the known and customary practice within the art to which the invention pertains.

What is claimed is:

1. A recessed lighting system comprising:

a first elongate track member including a first recess extending longitudinally for a length of the first elongate track member;

a first electric conductor disposed in the first recess and extending longitudinally for the length of the first elongate track member;

a second elongate track member arranged alongside and spaced apart from the first elongate track member by a distance, the second elongate track member including a second recess extending longitudinally for a length of the second elongate track member;

a second electric conductor disposed in the second recess and extending longitudinally for the length of the second elongate track member;

a reflector spanning at least a portion of the distance between the first and second elongate track members;

a first plurality of light emitting diodes (LEDs) mounted on the first elongate track member and a second plurality of LEDs mounted on the second elongate track member, the first and second pluralities of LEDs being configured to emit light toward the reflector so that the reflector redirects the light to provide indirect lighting; and a direct lighting fixture arranged between and slidably supported by the first and second elongate track members so that the direct lighting fixture is movable along the first and second elongate track members.

2. The recessed lighting system of claim 1, the direct lighting fixture including:

a first electric contact received in the first recess and slidably engaging the first electric conductor; and a second electric contact received in the second recess and slidably engaging the second electric conductor.

3. The recessed lighting system of claim 1, comprising a low voltage transformer electrically coupled to the first and second electric conductors.

4. The recessed lighting system of claim 1, the first elongate track member including a first inclined wall, the second elongate track member including a second inclined wall, and the first and second inclined walls defining opposite sides of an opening that gradually increases in width.

5. The recessed lighting system of claim 1, the reflector including a semi-cylindrical reflective surface.

6. The recessed lighting system of claim 1, the direct lighting fixture including a locking member configured to prevent movement of the direct lighting fixture relative to the first and second elongate track members when engaged and allow movement of the direct lighting fixture relative to the first and second elongate track members when disengaged.

7. The recessed lighting system of claim 1, the direct lighting fixture including a third plurality of LEDs.

8. The recessed lighting system of claim 1, the direct lighting fixture including a mounting structure and a light source housing, the mounting structure being slidably supported by the first and second elongate track members, and the light source housing being removably attached to the mounting structure.

9. The recessed lighting system of claim 8, the light source housing being suspended from the mounting structure by a flexible cable.

10. A light emitting track assembly for use in a recessed lighting system, comprising:

a first elongate track member including a first recess extending longitudinally for a length of the first elongate track member;

a first electric conductor disposed in the first recess and extending longitudinally for the length of the first elongate track member;

a second elongate track member arranged alongside and spaced apart from the first elongate track member by a distance, the second elongate track member including a second recess extending longitudinally for a length of the second elongate track member; and a first plurality of light emitting diodes (LEDs) mounted on the first elongate track member.

11. The light emitting track assembly of claim of claim 10, comprising a reflector spanning at least a portion of the distance between the first and second elongate track members, wherein the first plurality of LEDs is configured to emit light toward the reflector so that the reflector redirects the light to provide indirect lighting.

12. The light emitting track assembly of claim 11, comprising a second electric conductor disposed in the second recess and extending longitudinally for the length of the second elongate track member.

13. The light emitting track assembly of claim 12, comprising a second plurality of LEDs mounted on the second elongate track member and configured to emit light toward the reflector so that the reflector provides additional indirect lighting.

14. The light emitting track assembly of claim 13, comprising a low voltage transformer electrically coupled to the first and second electric conductors.

15. The light emitting track assembly of claim 11, the first elongate track member including a first inclined wall, the second elongate track member including a second inclined wall, and the first and second inclined walls defining opposite sides of an opening that gradually increases in width.

16. The light emitting track assembly of claim 11, the first track member including an outer wall and an inner wall, the inner wall being inclined relative to the outer wall.

17. The light emitting track assembly of claim 16, the first plurality of LEDs being arranged between the outer wall and the inner wall.

18. A recessed lighting system comprising:

means for generating indirect lighting including at least one plurality of light emitting diodes (LEDs) arranged parallel to a longitudinal axis of the recessed lighting system; and means for generating direct lighting suspended from the means for generating indirect lighting and movable in a direction parallel to the longitudinal axis of the recessed lighting system, wherein the means for generating direct lighting includes at least one light source separate from the plurality of LEDs.

19. The recessed lighting system of claim 18, the means for generating indirect lighting including a reflector configured to redirect the light emitted from the plurality of LEDs.

20. The recessed lighting system of claim 18, comprising a means for locking the means for generating direct lighting to the means for generating indirect lighting so that the means for generating direct lighting cannot move relative to the means for generating indirect lighting.

* * * * *